US011649959B2

(12) United States Patent
Streen et al.

(10) Patent No.: US 11,649,959 B2
(45) Date of Patent: May 16, 2023

(54) LIGHTED WEDGE TOOL

(71) Applicant: Edgy Tools LLC, Chandler, AZ (US)

(72) Inventors: David Streen, Chandler, AZ (US); Marino Cecchi, Sun City West, AZ (US); James Losser, St. Charles, IL (US); Joshua Michael Radloff, Hogansville, GA (US); Salvatore Vincent Mario Giuliano, Riverside, CA (US)

( * ) Notice: Subject to any disclaimer, the term of this patent is extended or adjusted under 35 U.S.C. 154(b) by 0 days.

(21) Appl. No.: 17/425,202

(22) PCT Filed: Jan. 22, 2020

(86) PCT No.: PCT/US2020/014660
§ 371 (c)(1),
(2) Date: Jul. 22, 2021

(87) PCT Pub. No.: WO2020/154438
PCT Pub. Date: Jul. 30, 2020

(65) Prior Publication Data

US 2022/0090775 A1 Mar. 24, 2022

Related U.S. Application Data

(60) Provisional application No. 62/795,494, filed on Jan. 22, 2019.

(51) Int. Cl.
*F21V 33/00* (2006.01)
*B25B 27/00* (2006.01)
(Continued)

(52) U.S. Cl.
CPC ..... *F21V 33/00* (2013.01); *B25B 27/0035* (2013.01); *B25B 27/02* (2013.01); *F21Y 2115/10* (2016.08)

(58) Field of Classification Search
CPC ..... F21V 33/0084; F21L 4/027; F21K 9/61; G02B 6/0046; G02B 6/0048
See application file for complete search history.

(56) References Cited

U.S. PATENT DOCUMENTS 4,068,121 A * 1/1978 Bringhurst ..... G02B 19/0028 136/246
5,104,094 A * 4/1992 Womack ..... E05B 19/20 81/488

(Continued)

FOREIGN PATENT DOCUMENTS

WO 2008/064473 A1 6/2008

OTHER PUBLICATIONS

Facebook post and webpage for Dentcraft Tools Inspection Wedge, www.dentcrafttools.com/inspectiion-wedge-lighted-win; Jun. 6, 2019.

(Continued)

*Primary Examiner* — Ismael Negron

(57) ABSTRACT

A wedge tool includes an elongated body having a cavity disposed within its proximal portion, the body having two vertical sides intersecting two force-applying surfaces with a tapered, curved profile to define a blade at a distal end of the body. At least one a light emitter within the body emits light from the distal portion. A power source is disposed within the cavity for providing power to the light emitter.

18 Claims, 2 Drawing Sheets

(51) Int. Cl.
*B25B 27/02* (2006.01)
*F21Y 115/10* (2016.01)

(56) References Cited

U.S. PATENT DOCUMENTS 5,437,540 A 8/1995 Blocker
5,697,656 A * 12/1997 Hebert ..... E05C 17/54 292/343
5,921,673 A * 7/1999 Habel ..... G02B 6/0006 362/120
6,082,876 A * 7/2000 Hanson ..... A63H 33/22 362/186
6,364,289 B1 4/2002 Cook
6,471,388 B1 * 10/2002 Marsh ..... G02B 6/0068 362/217.05
6,727,805 B2 * 4/2004 Hollister ..... G08B 7/06 292/342
7,771,073 B2 * 8/2010 Chen ..... A47G 19/2227 362/605
7,862,193 B1 * 1/2011 Quittner ..... F21V 21/0885 362/205
8,162,826 B2 4/2012 Pecherer
9,583,028 B2 * 2/2017 Killion ..... G09F 13/10
10,190,756 B2 * 1/2019 Ford ..... F21V 5/006
2005/0057742 A1 3/2005 McClurg
2005/0159649 A1 7/2005 Patel
2007/0112257 A1 * 5/2007 Hensler ..... A61B 1/0684 600/199
2009/0196025 A1 8/2009 Joseph
2021/0145268 A1 * 5/2021 Elbaz ..... A61B 1/07

OTHER PUBLICATIONS

International Search Report PCT/US2020/014660, dated Apr. 1, 2020, 8 pages.

* cited by examiner

LIGHTED WEDGE TOOL

RELATED APPLICATIONS

The present application is a 371 national stage filing of International Application No. PCT/US2020/014660, filed Jan. 22, 2020, which claims the benefit of the priority of U.S. provisional application No. 62/795,494, filed Jan. 22, 2019, each of which is incorporated herein by reference in its entirety.

FIELD OF THE INVENTION

The present invention relates to a tool for illuminating the interior of a vehicle door or other restricted space to facilitate repairs.

BACKGROUND OF THE INVENTION

The first step used by a locksmith or technician in the process of opening a locked car door, for example, in cases where the driver may have misplaced the key, involves separating the window glass from the door seal to create a space sufficient for insertion of a conventional locksmith's probing tool. The door seal, or "wiper", is a rubber or rubber-like strip of material on either side of the car window at the top of the door. The wiper prevents water from entering the door while the window is rolled up, and as the window is rolled down, wipes water droplets from the surface of the glass. Tools have been developed to separate the wiper from the window, to facilitate insertion of tools designed to release the door lock. Such tools are generally known as wedges, with a blade end, which is used to initiate separation between the wiper and the window. and a tapered, progressively increasing thickness. As the wedge is further inserted, the thickness of the wedge increases the separation between the wiper and window, allowing access for unlocking tools. A sample locksmith wedge is described in U.S. Pat. No. 6,364,289 of Cook.

In the field of vehicle body repair, particularly for paintless dent repair (PDR), the need exists for accessing the interior of a vehicle door panel or in other restricted spaces or in concealed areas to perform various repairs. Window wedge-like tools of various sizes and designs have been used by PDR technicians to gain access to the inside of vehicle doors and panels for quite some time. However, unlike the needs of a locksmith, who can typically probe around within the panel cavity with a bar to find the locking mechanism without the need to visualize the cavity's interior, a PDR technician cannot simply feel around to find the target repair site for properly positioning a door hook or other PDR door tool. Rather, he or she actually needs to see into the cavity, which means illumination is required. Currently, there are few solutions offered for lighting during PDR work, most of which are planar assemblies of LED strips that can be positioned within restricted work areas using suction cups, but are too large for insertion into narrow spaces such as inside a vehicle door. Accordingly, the need remains for a lighting solution for this specialized work.

BRIEF SUMMARY

In an exemplary embodiment, a lighted wedge tool includes a wedge body having a shape generally similar to that disclosed in U.S. Pat. No. 6,364,289, modified to include a hollow cavity for retaining a light module. The light module includes a light source and optics, a battery compartment, an on/off switch, and appropriate supporting circuitry. In some embodiments, the light source is a light emitting diode (LED), incandescent or halogen bulb, diode laser, or a combination light source and optical fiber. The optics may include a lens for focusing, shaping, or spreading a beam of light emitted by the light source. The battery may be a small battery such as AA or AAA, lithium button batteries, or other compact battery packs, which may optionally be rechargeable. In one embodiment, the end of the wedge may be formed from a transparent or translucent material that acts as a light diffuser to spread the light from all surfaces of the tip. In another embodiment, the LED, or an end of an optical fiber or fiber bundle, may be slightly recessed in the tip of the wedge to protect the optics while providing a point source of light that can be spread with a lens such as a fish-eye or other beam-spreading optics. In other embodiments, one or more lenses may be located on one or both sides of the wedge, to emit light sideways, transverse to the longitudinal axis of the wedge.

In one aspect of the invention, a wedge tool includes an elongated body having a cavity disposed within a proximal portion thereof, the body having two sides and two tapered, curved profile defining force-applying surfaces with a blade formed at a distal end of a distal portion of the body; at least one a light emitter configured to emit light from the distal portion; and a power source disposed within the cavity for providing power to the light emitter. In one embodiment, the distal portion is formed from a light diffusing material, wherein the at least one light emitter is disposed within the light diffusing material to emit light from surfaces of the light diffusing material. In another embodiment, the light emitter is an optical fiber extending through the distal portion of the body, where the optical fiber communicates light to an opening at the distal end. This embodiment may further include multiple LEDs disposed within each side of the body.

The at least one light emitter may be multiple LEDs disposed within each side of the body. In some embodiments, at least a portion of one of the force-applying surfaces may have a plurality of transverse ribs formed therein. The light emitter may be formed from polymethylmethacrylate (PMMA), polycarbonate (PC) or similar translucent plastic or polymer, while the proximal portion of the body may be formed any appropriate rigid, minimally compressible material, which may be wood, metal, plastic or polymer. In some embodiments, the body material may be acrylonitrile butadiene styrene (ABS) or similar thermoplastic polymer, or Nylon.

In another aspect of the invention, a window wedge tool includes an elongated body having a cavity disposed within a proximal portion thereof, the body having two vertical sides intersecting two force-applying surfaces having a tapered, curved profile to define a blade formed at a distal end of a distal portion of the body; at least one a light emitter configured to emit light from the distal portion; and a power source disposed within the cavity for providing power to the light emitter. In one embodiment, the distal portion is formed from a light diffusing material, wherein the at least one light emitter is disposed within the light diffusing material to emit light from surfaces of the light diffusing material. In another embodiment, the light emitter is an optical fiber extending through the distal portion of the body, where the optical fiber communicates light to an opening at the distal end. This embodiment may further include multiple LEDs disposed within each side of the body.

The at least one light emitter may be multiple LEDs disposed within each side of the body. In some embodiments, at least a portion of one of the force-applying surfaces may have a plurality of transverse ribs formed therein. The light emitter may be formed from polymethylmethacrylate (PMMA), polycarbonate (PC) or similar translucent plastic or polymer, while, in some embodiments, the proximal portion of the body may be formed from acrylonitrile butadiene styrene (ABS) or similar thermoplastic polymer, or Nylon.

DETAILED DESCRIPTION OF EMBODIMENTS OF THE INVENTION

As shown in FIGS. 1-4, the inventive wedge light generally includes a tapered body that is at least partially hollow, a lens located near the narrow end of the body, and a light module that is fully or partially retained within the body. In most embodiments, the body has a wide curve or parabolic profile that extends the length of the body to facilitate handling and insertion.

Figure 1:
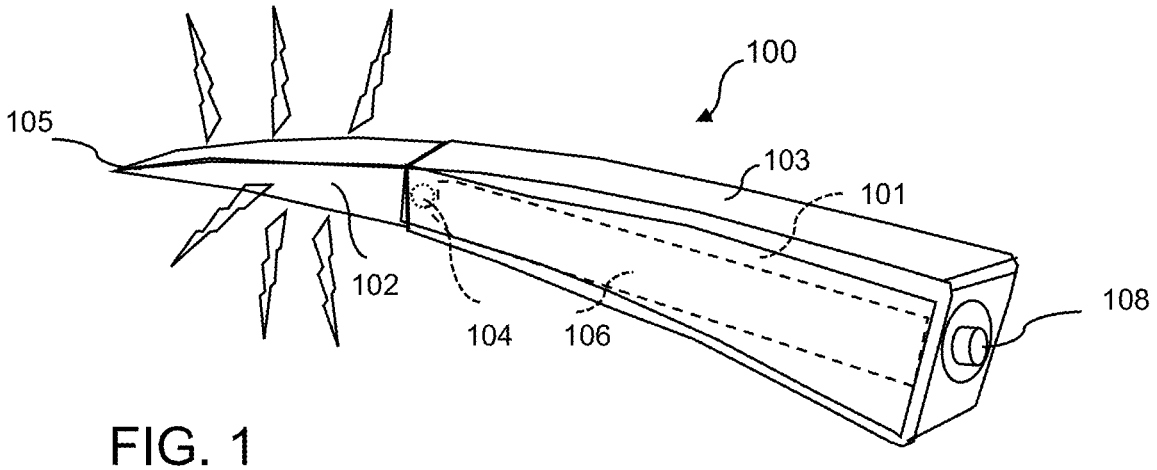
FIG. 1 is a perspective view of a first embodiment of a lighted wedge tool.

Referring to FIG. 1, a first embodiment of the inventive wedge light 100 includes an elongated hollow body 103 with an interior cavity 101 dimensioned for receiving a battery-powered pen light 106 with a light-emitter 104, e.g., one or more LEDS, incandescent bulbs, halogen bulbs, or other light emitter, at one end and a switch 108 at its other end. Pen lights of this type are widely available commercially and may be powered by a common AA or AAA battery, or any of a variety of button cell batteries, including alkaline, lithium, silver oxide, etc. The cavity 101 may be openable via a door, slide, or plate, in a side or at the proximal end of the body that allows the entire pen light to be accessed, either for removal/insertion of the entire light, or for battery removal/replacement. The pen light may be permanently/semi-permanently retained within the interior cavity 101, or the cavity may be simply configured to temporarily retain a separate pen light that can be slid into and out of the cavity when needed. The switch 108, which may be a push-button latching switch, a toggle switch, slide switch, or other conventional on-off switch, is accessible on the outside of the distal end of the body 103. Where a separable pen light is used, the switch 108 may be the switch on the light itself rather than a dedicated switch attached to the end of the body. The body 103 may be formed from any of a number of rigid materials, including wood, metal, or hard plastics or polymers. In some embodiments, the material may be injection-molded or machined acrylonitrile butadiene styrene (ABS) or similar thermoplastic polymer, or Nylon, e.g., Nylon 6 or Nylon 66, similar polyamides, or other durable, non-compressible, high strength material. The body should be smooth, without sharp edges or protrusions that could scratch the window, wiper, or other surface.

Attached to the distal end of body 103 is a lens 102, which can be either co-molded or mechanically attached to the body 103 using fasteners, adhesive, or a combination thereof. The lens 102 tapers at its distal end down to a blade end 105, which has sufficient rigidity to initiate the separation between the two objects to be separated. The lens 102 continues the parabolic profile of the body, with a tight joint between the body and lens to provide a uniform surface for contacting the window and wiper. In the embodiment shown in FIG. 1, the lens 102 is formed from a material that is translucent or transparent for light transmission. In a preferred embodiment, the lens material acts as a diffuser, so that light from light-emitter 104 is diffused throughout the lens to be emitted from all surfaces of the lens. Lens 102 may be formed from polymethylmethacrylate (PMMA) or polycarbonate (PC), or similar light-transmissive hard plastic or polymer.

Figure 2:
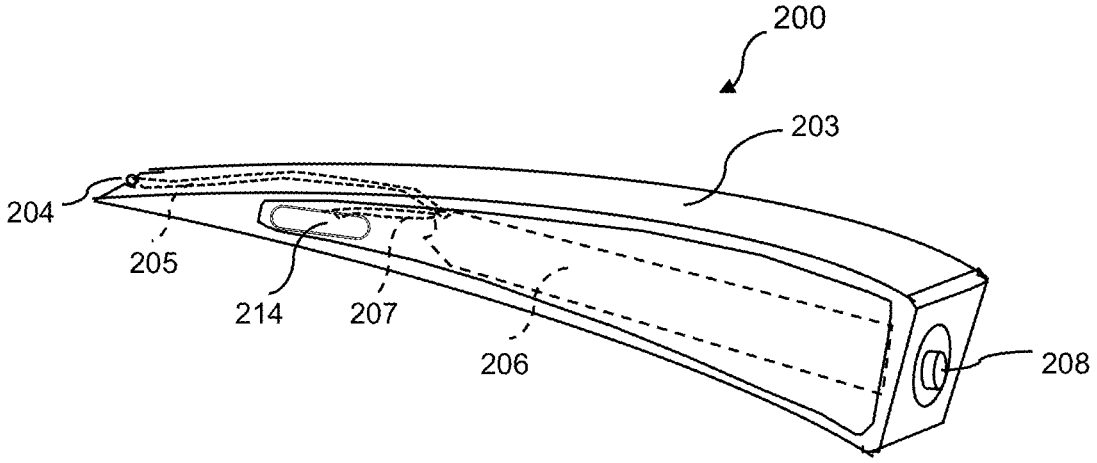
FIG. 2 is a perspective view of another embodiment of a lighted wedge tool.

An alternative embodiment of the wedge light 200 is shown in FIG. 2. The body 203 is formed as a continuous wedge from the proximal end, where switch 208 is located, to the distal blade end. A window or small opening 204 in the blade end provides support for the end of an optical fiber 205 that is connected at its other end to a light emitter of light source 206, so that light is transmitted from the light source through the fiber and projected from the window 204. The end of the fiber 205 may be flat or may be formed as a convex lens to expand the beam of the projected light. The fiber end may be at least partially recessed within the window to protect against damage during use. Optionally, wedge light 200 may also include separate light emitters 214 on either side of the body, where the emitter 214 is recessed within, or at least flush with, the side surfaces of the body to protect against damage. Emitters 214 may be an LED module connected by a wire 207 to LED driver circuitry and a battery within light source 206, or may be connected via an additional optical fiber to the light emitter of light source 206. Optional lens may be provided for the side emitters 214 to expand the beam of projected light.

Figure 3:
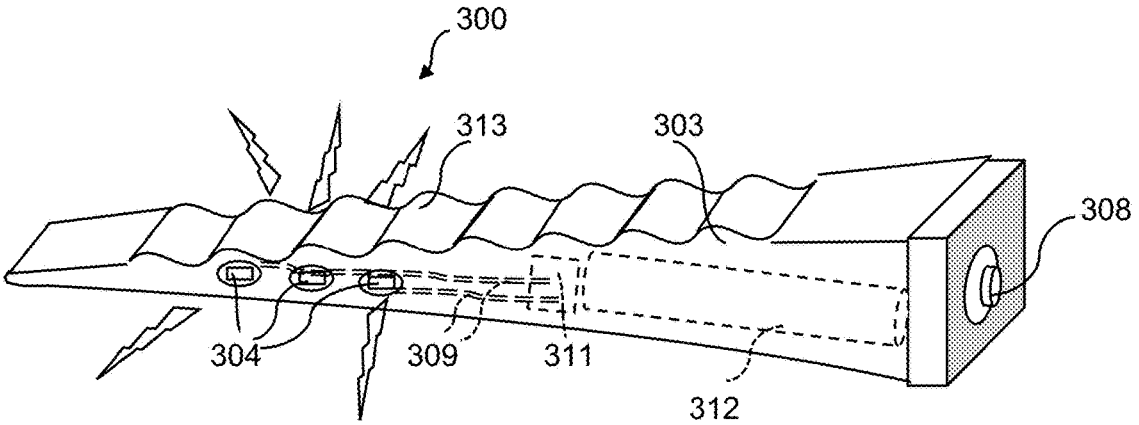
FIG. 3 is a perspective view of still another embodiment of a lighted wedge tool with a ribbed surface and LEDs disposed along the sides of the wedge body.

A third embodiment of the inventive wedge light 300 is shown in FIG. 3. In this embodiment, body 303 has a partially ribbed upper surface 313 along a portion of its length. The ribbed surface facilitates handling of the tool. On each side of the body are disposed a plurality of light emitters arranged in a line running lengthwise. In FIG. 3, three LEDs 304 are shown, however more or fewer light emitters may be provided to project light from the sides of the body 303. The LEDs 304 are preferably flush or slight recessed from the outer surface of the body to reduce the risk of damage to the LEDs as the tool is inserted and retracted. Each light emitter 304 is connected via wiring 309 to LED driver circuitry on printed circuit board 311 which is connected to battery 312. As in the previously described embodiments, a switch 308 is provided to activate the light. Although not shown, the distal, blade end of wedge light body may include a lens and light emitter, also powered by the driver circuitry and battery.

Figure 4:
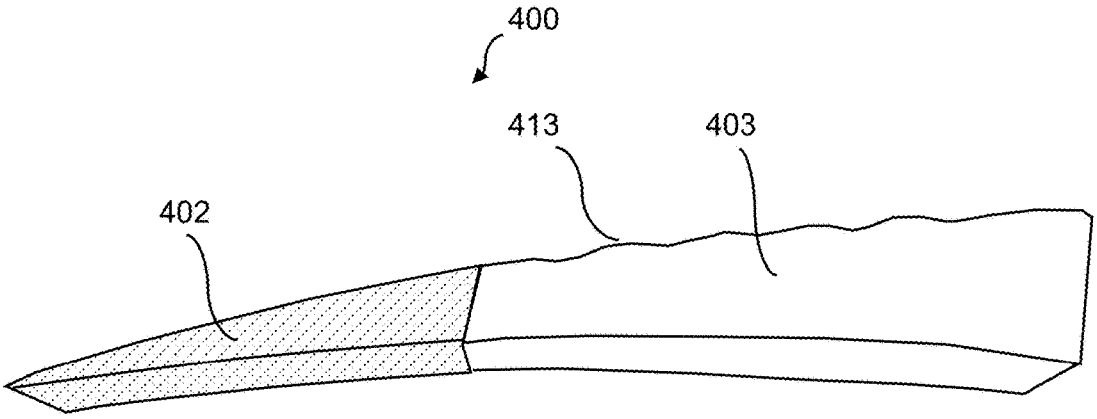
FIG. 4 is a perspective view of another embodiment of a lighted wedge tool with a diffusing lens.

FIG. 4 illustrates a variation on the embodiment of FIG. 1. As shown wedge light 400 includes a ribbed upper surface 413 on body 403, attached to a relatively elongated lens portion 402 formed from a translucent or transparent diffusing material that will emit light from all surfaces of the lens. As in the preceding embodiments, the light and power sources are retained within a cavity in body 403.

Exemplary dimensions for the inventive wedge light are on the order of 10-20 cm in length, about 0.75-2 cm in width, and 1.5 to 3 cm in depth. These dimensions are provided as an example only. It will be readily apparent to those in the art that different sizes of the wedge light may be designed for different applications. While in most embodiments, LEDs are described, it will be apparent to those in the art, that different or additional light sources may be employed for equal or enhanced utility. For example, different color LEDs may be used to facilitate visualization in certain situations. In another example, a low power laser pointer may be added to an LED or other light emitter to facilitate fine positioning at the work target.

Although several exemplary implementations of the invention have been described, it will be apparent to those skilled in the art that modifications and alternative embodiments of the invention may be made, including different combinations of features of the various exemplary embodiments. The foregoing disclosure contemplates all such modifications and alterations of the features, and is not intended to limit the scope of the invention or to preclude coverage of obvious modifications or equivalent embodiments. Accordingly, the scope of the invention is intended to be limited only by the following claims.

The invention claimed is:

1. A wedge tool, comprising:

an elongated wedge-shaped body formed from a rigid material and having a cavity disposed within a proximal portion thereof, the body having a length, two sides, and two tapered, curved profile defining force-applying surfaces with a blade formed at a distal end of a distal portion of the body, wherein at least a portion of one of the force-applying surfaces has a plurality of transverse ribs formed therein;

at least one light emitter configured to emit light from the distal portion; and a power source disposed within the cavity for providing power to the light emitter;

wherein the wedge-shaped body has a sufficient amount of rigidity to increase a separation between a seal and a window as the tool is inserted therebetween.

2. The wedge tool of claim 1, wherein the distal portion comprises a rigid light diffusing material, wherein the at least one light emitter is disposed within the light diffusing material to emit light from surfaces of the light diffusing material.

3. The wedge tool of claim 1, wherein the at least one light emitter comprises a plurality of LEDs disposed within each side of the body.

4. The wedge tool of claim 1, wherein the at least one light emitter is formed from polymethylmethacrylate (PMMA) or polycarbonate (PC).

5. The wedge tool of claim 1, wherein at least the proximal portion of the body is formed from acrylonitrile butadiene styrene (ABS), a thermoplastic polymer, or Nylon.

6. The wedge tool of claim 1, wherein the at least one light emitter comprises an optical fiber extending through the distal portion of the body, wherein the optical fiber communicates light to an opening at a distal end.

7. The wedge tool of claim 6, further comprising a plurality of LEDs disposed within each side of the body.

8. A wedge tool, comprising:

an elongated wedge-shaped body formed from a rigid material and having a cavity disposed within a proximal portion thereof, the body having a length and comprising two sides intersecting two force-applying surfaces having a tapered, curved profile with a blade formed at a distal end of a distal portion of the body, wherein at least a portion of one of the force-applying surfaces has a plurality of transverse ribs formed therein;

at least one a light emitter configured to emit light from the distal portion; and a power source disposed within the cavity for providing power to the light emitter;

wherein the wedge-shaped body has a sufficient amount of rigidity to increase a separation between a seal and a window as the force-applying surfaces are inserted therebetween.

9. The wedge tool of claim 8, wherein the distal portion comprises a light diffusing material, wherein the at least one light emitter is at least partially disposed within the light diffusing material to emit light from surfaces of the light diffusing material.

10. The wedge tool of claim 8, wherein the at least one light emitter comprises a plurality of LEDs disposed within each side of the body.

11. The wedge tool of claim 8, wherein the at least one light emitter is formed from polymethylmethacrylate (PMMA) or polycarbonate (PC).

12. The wedge tool of claim 8, wherein at least the proximal portion of the body is formed from acrylonitrile butadiene styrene (ABS), a thermoplastic polymer, or Nylon.

13. The wedge tool of claim 8, wherein the at least one light emitter comprises an optical fiber extending through the distal portion of the body to communicate light to a light transmissive window at a distal end.

14. The wedge tool of claim 13, further comprising a plurality of LEDs disposed within each side of the body.

15. A wedge tool for increasing a separation between a seal and a window, the wedge tool comprising:

an elongated body formed from a rigid material and having a length, a distal portion, and a proximal portion, the body having upper and lower surfaces configured to define a tapered, curved profile that extends along a length of the body with an increasing thickness from a blade disposed at the distal portion to the proximal portion, the body having a cavity disposed within the proximal portion;

at least one light emitter configured to emit light from the distal portion; and a power source disposed within the cavity for providing power to the light emitter;

wherein the blade has a sufficient amount of rigidity for insertion between the seal and the window and the upper and lower surfaces are configured to increase a separation between the seal and the window as the tool is further inserted, and wherein the upper surface has a plurality of transverse ribs formed therein.

16. The wedge tool of claim 15, wherein the distal portion comprises a light diffusing material, wherein the at least one light emitter is at least partially disposed within the light diffusing material to emit light from surfaces of the light diffusing material.

17. The wedge tool of claim 15, wherein the at least one light emitter comprises an optical fiber extending through the distal portion of the body to communicate light to a light transmissive window at a distal end.

18. The wedge tool of claim 15, further comprising a plurality of LEDs disposed within each side of the body.

* * * * *